US009677853B2

(12) United States Patent
Haugen

(10) Patent No.: US 9,677,853 B2
(45) Date of Patent: Jun. 13, 2017

(54) MOUNT FOR A TELESCOPIC SIGHT

(71) Applicant: GRS Riflestocks AS, Hornindal (NO)

(72) Inventor: Havard Haugen, Hornindal (NO)

(73) Assignee: GRS Riflestocks AS, Hornindal (NO)

( * ) Notice: Subject to any disclaimer, the term of this patent is extended or adjusted under 35 U.S.C. 154(b) by 0 days.

(21) Appl. No.: 15/059,324

(22) Filed: Mar. 3, 2016

(65) Prior Publication Data

US 2016/0258716 A1 Sep. 8, 2016

(30) Foreign Application Priority Data

Mar. 5, 2015 (NO) ..... 20150300

(51) Int. Cl.
*F41G 11/00* (2006.01)

(52) U.S. Cl.
CPC ..... *F41G 11/003* (2013.01); *F41G 11/005* (2013.01)

(58) Field of Classification Search
CPC .... F41G 11/001; F41G 11/003; F41G 11/004; F41G 11/005; F41G 11/006; F41G 11/007
USPC ..... 42/124, 125, 126, 127, 128
See application file for complete search history.

(56) References Cited

U.S. PATENT DOCUMENTS 7,121,037 B2 * 10/2006 Penney ..... F41G 11/001 42/126
7,140,143 B1 11/2006 Ivey
7,543,405 B1 6/2009 Ivey
2006/0010759 A1 * 1/2006 Penney ..... F41G 11/001 42/126
2009/0307956 A1 12/2009 Barret
2010/0162611 A1 * 7/2010 Samson ..... F41G 1/18 42/125
2010/0263256 A1 * 10/2010 Spinelli ..... F41G 11/003 42/124
2014/0096429 A1 4/2014 Sandler
2014/0157648 A1 * 6/2014 Haering ..... F41G 11/003 42/125

FOREIGN PATENT DOCUMENTS

CA 2512872 * 8/2004
DE 1902984 5/1979

OTHER PUBLICATIONS

EPO Search report of Aug. 7, 2016, submitted inter alia as statement of relevance for non-english reference cited therein.

* cited by examiner

*Primary Examiner* — Stephen M Johnson
(74) *Attorney, Agent, or Firm* — Christian D. Abel

(57) ABSTRACT

The present invention relates to a device for mounting and adjustment of a telescopic sight on a firearm, where the device comprises a front telescopic sight ring and a rear telescopic sight ring and where the front and rear telescopic sight ring further comprises an upper half-ring and a lower half-ring, where the lower half-ring of each telescope sight ring is connected to an intermediate piece, where each intermediate piece is further connected to a telescopic sight ring base, and where it between one of the telescopic sight ring bases and the intermediate pieces is arranged an adjustment device, allowing for adjustment of the telescopic sight.

11 Claims, 4 Drawing Sheets

MOUNT FOR A TELESCOPIC SIGHT

FIELD OF THE INVENTION

The present invention relates to a device for mounting a telescopic sight on a firearm, and more particularly, the present invention relates to an adjustable mounting for a telescopic sight.

BACKGROUND OF THE INVENTION

A telescopic sight mounted on a weapon is usually attached to the firearm by two elements; a base which through appropriate devices is directly connected to a barrel of the firearm, and rings which secure the riflescope to the base. Both the base and rings can be obtained in a number of different embodiments and from many manufacturers. There are two main categories —universal standard bases and standard rings, where these can be combined regardless of manufacturer and/or model, or more specific bases with quick connectors, swivel mountings and the like, where the manufacturer supplies both the base and suitable rings which fit the base.

The most common universal bases are Weaver bases and Picatinny bases, also known as MIL-STD-1913 bases or 1913 Picatinny bases.

Most telescopic sights have some form of lateral and height adjustment of the telescopic sight. When attending to such lateral and height adjustment, an adjustment screw or equivalent is used to move a reticle in the telescopic sight so that the telescopic sight can be set to hit whatever one is aiming at and/or in relation to the distance one wishes to shoot. The range such a telescopic sight can be able to be adjusted will depend on the manufacturer and model or the type of telescopic sight. As a rule, telescopic sights with a large adjustment range will be preferable.

The unit for angular measurement which is mostly used to indicate how much a telescopic sight is set by rotation of an adjusting screw is MOA—Minute Of Angle, where 60 MOA form 1 degree of a circle. A typical telescopic sight usually has somewhere between 50 and 150 MOA adjustment. Most telescopic sights will also be designed so that half of the telescopic sight's adjustment is downward, and half is upward, when the telescopic sight is mounted parallel to the barrel of the weapon (the so-called mechanical zero). This means, in practice, that one can only use half of the telescopic sight's adjustment range or adjustment possibility.

In order to utilize the telescopic sight better, angled bases or rails have been developed, where the angled bases or rails can also be adjusted in height in an area of 10-20-30 and 45 MOA. However, such bases or rails are not designed for all weapon brands. Furthermore, new telescopic sights which have recently come on the market often require considerably more adjustment than 10-45 MOA.

SUMMARY OF THE INVENTION

An object of the present invention is therefore to provide a device for mounting and adjustment of a telescopic sight on a firearm, where the disadvantages of the prior art are eliminated or at least partially eliminated.

U.S. Pat. Nos. 7,543,405 B1 and 7,140,143 B1 relates to a mounting system for a telescopic sight comprising an adjustable elevation mount formed from a scope ring and an adjustable sub-base. A clevis portion of the scope ring holds an elevation pin that is received by a vertical slot in the adjustable sub-base. An internally longitudinal bore is disposed through the adjustable sub-base and an externally threaded barrel disposed in an opening of the longitudinal bore. A cylindrical elevation cam having an angled slot is disposed in the longitudinal bore and includes a positioning rod that extends through a bore disposed through the barrel. The angled slot receives the elevation pin as it extends through a bore disposed through the vertical slot of the sub-base. A bi-directional cam capture is mechanically coupled to the elevation cam and provides for longitudinal displacement of the elevation cam through the cam bore. Detent mechanisms are incorporated in the cam capture means to provide audible or felt indication of elevation position.

Yet another object of the present invention is to provide a simple and compact device for mounting and adjusting a telescopic sight on a firearm, where the adjustment is easy to perform and where this adjustment does not result in the telescopic sight being raised much above the barrel of the firearm.

These objects are achieved with a device for mounting and adjustment of a telescopic sight on a firearm according to the following independent claim, where further features of the invention appear from the dependent claims and the description below.

A firearm according to the present invention is understood to include both long weapons, such as rifles and shotguns, and handguns, such as revolvers and pistols.

According to the present invention there is provided a device for mounting and adjustment of a telescopic sight on a firearm, where the device comprises a front telescopic sight ring and a rear telescopic sight ring. Each of the front and rear telescopic sight rings further comprises an upper half-ring and a lower half-ring, which by means of fastening means are screwed together when the telescopic sight is arranged in the telescopic sight rings. Each of the lower half-rings of the front and rear telescopic sight rings is connected to its respective intermediate pieces and each intermediate piece is further connected to a telescopic sight ring base, where an adjusting device is arranged between one of the intermediate pieces and the corresponding telescopic sight ring base.

Each telescopic sight ring base is further designed, by means of a clamp device, to be connected to a universal rail for a firearm, so that the device for mounting and adjustment of a telescopic sight, with corresponding telescopic sight, can be mounted on the firearm.

The universal rail may be manufactured in one single piece, or of several components which are assembled to form the universal rail. The universal rail does not form part of the present invention, but it is referred to this, so as to give a full understanding of the present invention.

Each lower half-ring and each intermediate piece is preferably formed with a number of corresponding holes, so that a lower half-ring may be connected with an intermediate piece by means of bolts, screws or the like. In one embodiment, the intermediate pieces may be formed with a different number of holes, and the front intermediate piece may, for instance, being formed with six holes, while the rear intermediate piece may be formed with five holes.

The intermediate pieces may be formed with a groove over at least part of its length, in order to receive a surface on the lower half-ring.

One of the intermediate pieces may be formed with a through-going hole, while the second intermediate piece may be formed with a recess, where the hole and the recess are designed to receive a bolt or the like when an intermediate piece is to be connected to a telescopic sight ring base.

Each telescopic sight ring base may then be provided on an upper side with two upstanding flanges, where a through-going hole is formed through each flange. The through-going holes are further arranged to be in line with each other, so that a bolt or the like can be guided through the one through-going hole in the one flange, further through the hole or recess in the intermediate piece, and further out through the second through-going hole in the other flange, so as to connect the telescopic sight ring base and the intermediate piece.

The bolt can be designed to be locked by a nut or the like, where the nut can be arranged on or integrated in the one flange, or the nut can be loose. A skilled person will know that an intermediate piece and a telescopic sight ring base according to the present invention also can be connected in other ways.

One or both of the upper half-rings may in one embodiment, for example, comprise three separate sub-half-rings, so as to allow for better tightening around the telescopic sight when a telescopic sight is arranged in the telescopic sight rings.

Each telescopic sight ring base may further, on a lower side, be formed with two downwardly extending flanges, where each flange on an inside, over at least part of its length, is formed with at least one groove which cooperates with a groove formed in a universal rail, so as to allow for locking to the universal rail. It is also conceivable that a telescopic sight ring base can be locked to the universal rail by means of a clamp device. The telescopic sight ring base can in this case be formed with only one downwardly extending flange, and further be designed so as to cooperate with the clamp device.

The adjustment device according to the present invention comprises at least one spring or the like arranged between an intermediate piece and an associated telescopic sight ring base. The telescopic sight ring base and/or the intermediate piece may, on the surfaces facing each other, be formed with a seat or recess for receiving the at least one spring. A set or adjusting screw, which is formed with a pointed end, will cooperate with a corresponding angled surface provided internally in the intermediate piece. By tightening the set or adjustment screw, the set or adjustment screw will be guided along the angled surface provided internally in the intermediate piece, thus pushing the intermediate piece downwards. The intermediate piece will be allowed this movement, as the intermediate piece will be able to be "rotated" around the bolt that connects the intermediate piece and the telescopic sight ring base. The at least one spring disposed between the telescopic sight ring base and the intermediate piece will then be compressed. When the set or adjusting screw is screwed in the opposite direction, i.e. out, the set or adjusting screw is drawn away from the angled surface in the intermediate piece, whereby the at least one spring will push the intermediate piece upwards.

When the desired adjustment is achieved, a locking screw will be used to lock the intermediate piece and the telescopic sight ring base to each other, where also the bolt and nut which are connecting the intermediate piece and the telescopic sight ring base may be used as an additional means of locking in position.

The tapering of the set or adjustment screw and the angled surface of the intermediate piece may be in the range between 15 and 50 degrees.

Other advantages and features of the present invention will become apparent from the following detailed description, the accompanying figures and the appended claims.

BRIEF DESCRIPTION OF THE DRAWINGS

The invention will now be described with reference to the following figures, in which.

DETAILED DESCRIPTION OF THE INVENTION

Figure 1:
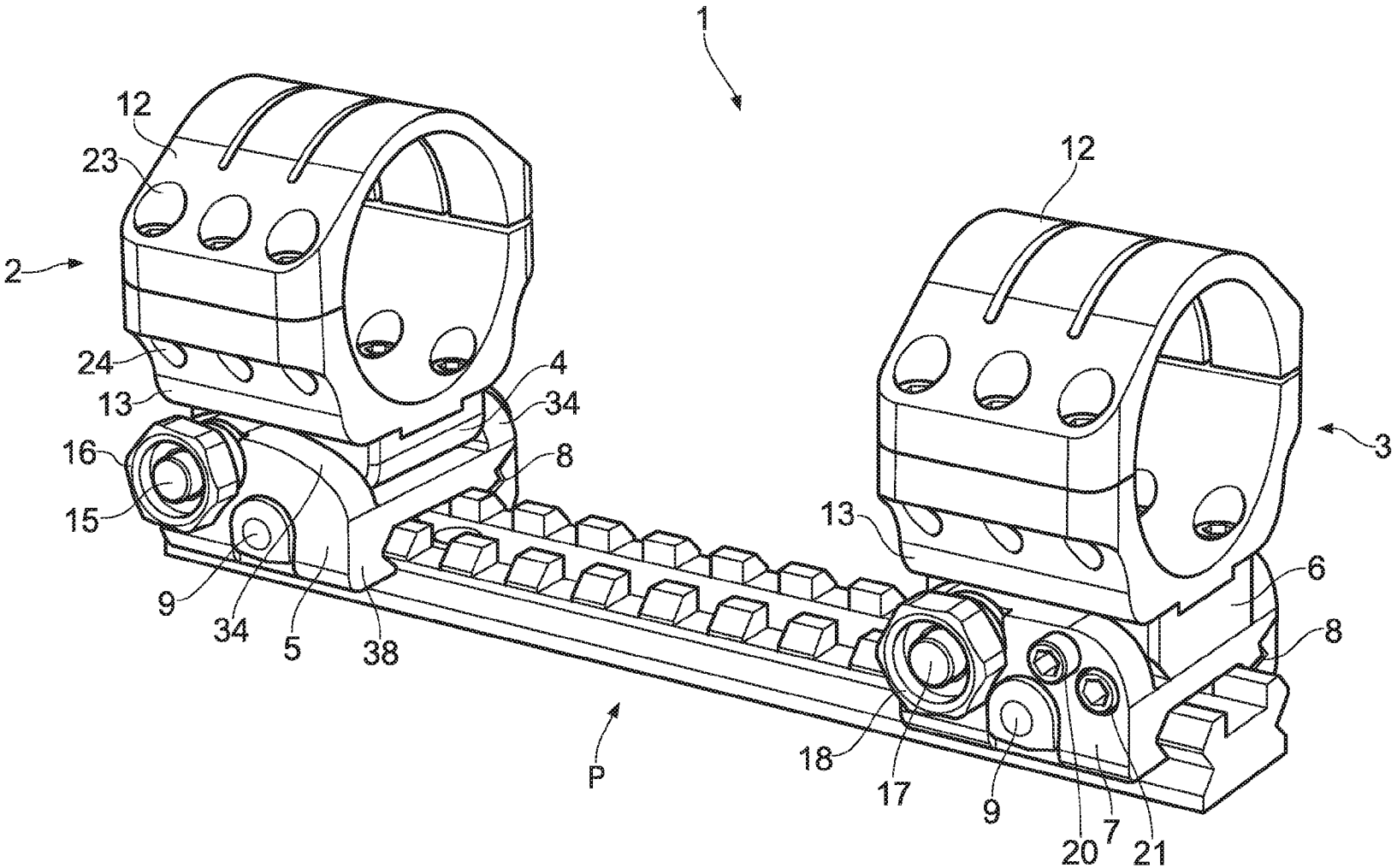
FIG. 1 shows an assembled device for mounting and adjustment of a telescopic sight for a firearm according to the present invention.

FIG. 1 shows a device 1 for mounting and adjustment of a telescopic sight (not shown) on a firearm (not shown) according to the present invention, where the device 1 for mounting and adjustment of a telescopic sight on a firearm is mounted on a so-called Picatinny rail P. The Picatinny rail P is not considered to form part of the present invention, but is shown so as to give a better understanding of how the device 1 according to the present invention is used.

The device 1 for mounting and adjustment of a telescopic sight includes a front telescopic sight ring 2 and a rear telescopic sight ring 3, where the front telescopic sight ring 2 further via a front intermediate piece 4 is connected to a front telescopic sight ring base 5. Similarly, the rear telescopic sight ring 3 will through a rear intermediate piece 6 be connected to a rear telescopic sight ring base 7. The front and rear telescopic sight ring base 5, 7 are further connected to the Picatinny rail P by means of their respective clamp device 8 and bolt 9 and nut 10.

The front and rear telescopic sight ring 2, 3 is connected to the front and rear intermediate piece 4, 6 by means of a number of screws 11. Each of the front and rear telescopic sight ring 2, 3 will further comprise an upper half-ring 12 and a lower half-ring 13, where the upper and lower half-rings 12, 13 are connected to each other through a plurality of screws 14.

The front intermediate piece 4 is pivotally connected with the front ring base 5, where a bolt 15 forms a pivot about which the front intermediate piece 4 can rotate. A nut 16 is used for screwing and tightening.

The rear intermediate piece 6 can be moved substantially vertically relative to the rear ring base 7, where a bolt 17 is used to control the movement of the rear intermediate piece 6 relative to the rear base 7. A nut 18 is used for screwing and tightening.

An adjustment device 19 is further arranged in connection with the rear intermediate piece 6 and the rear ring base 7, where the adjusting device 19 comprises a set or adjustment screw 20, a tightening or locking screw 21 and a spring 22.

The design of the front and rear telescopic sight rings 2, 3, front and rear intermediate pieces 4, 6, front and rear ring bases 5, 7, and the adjustment device 19 manner of operation will be explained further in relation to FIG. 4.

Figure 2:
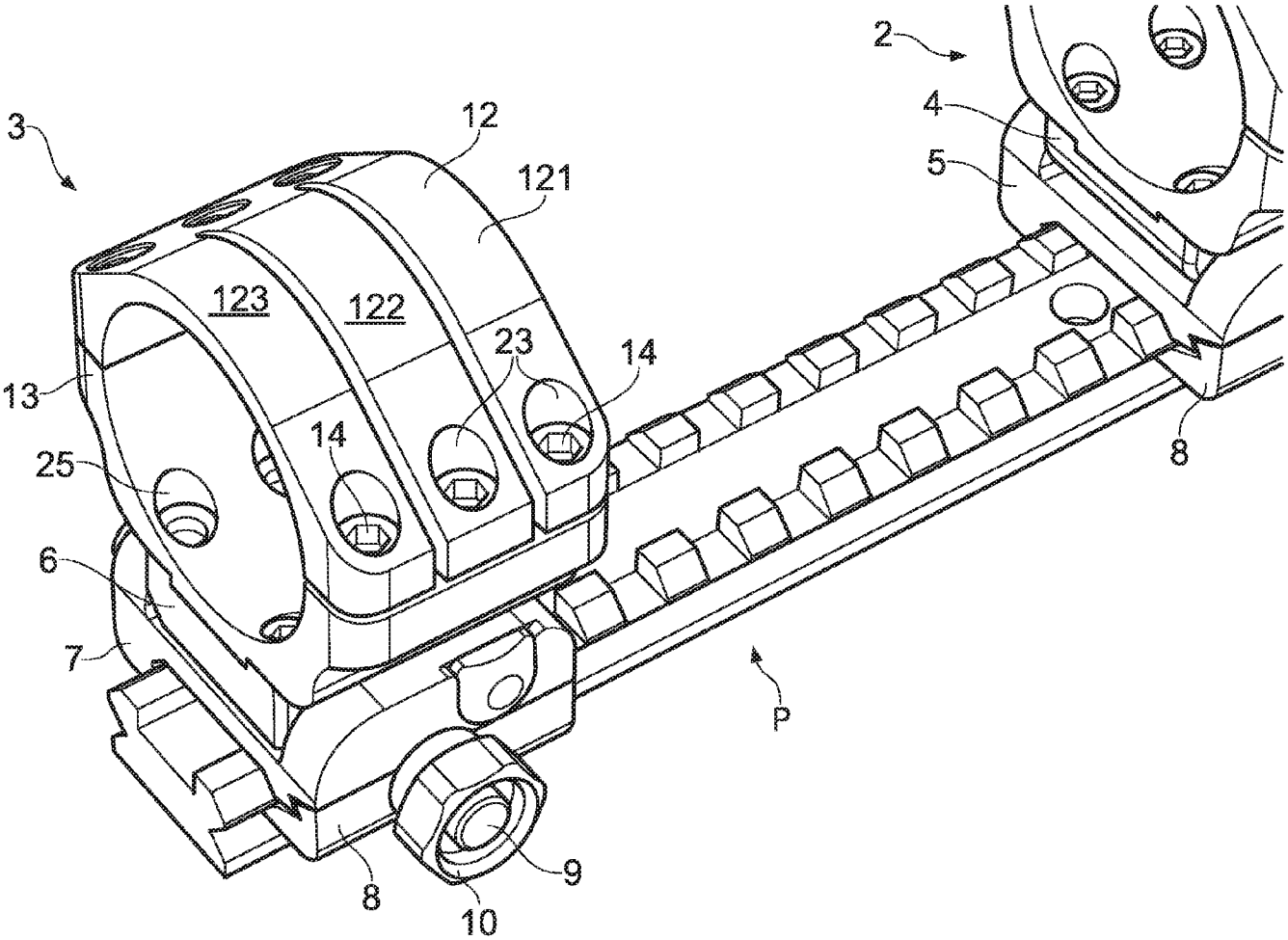
FIG. 2 shows details of a telescopic sight ring used in the device for mounting and adjustment of a telescopic sight according to FIG. 1.

FIG. 2 shows the rear telescopic sight ring 3 assembled, where it can be seen that the upper half-ring 12 is formed with six through-going holes 23. Similarly, the lower half-ring 13 will be formed with six partially through-going holes 24, where these holes 24 are formed with threads. Screws 14 are used to connect the upper and lower half-ring 12, 13.

The upper half-ring 12 is further formed with three sub-half rings 121, 122, 123 which are independent of each other, so that the rear telescopic sight ring 3 can be adapted more easily to different forms of a telescopic sight. The three sub-half rings 121, 122, 123 which are independent of each other may then be screwed individually relative to each other.

It is seen further that the lower half-ring 13 on an inside is formed with six through-going holes 25, wherein the rear intermediate piece 6 is formed with a corresponding number of partially through holes 26, where these holes 26 are formed with threads. The lower half-ring 13 and the rear intermediate piece 6 will then be connected to each other by use of screws 11.

Figure 3:
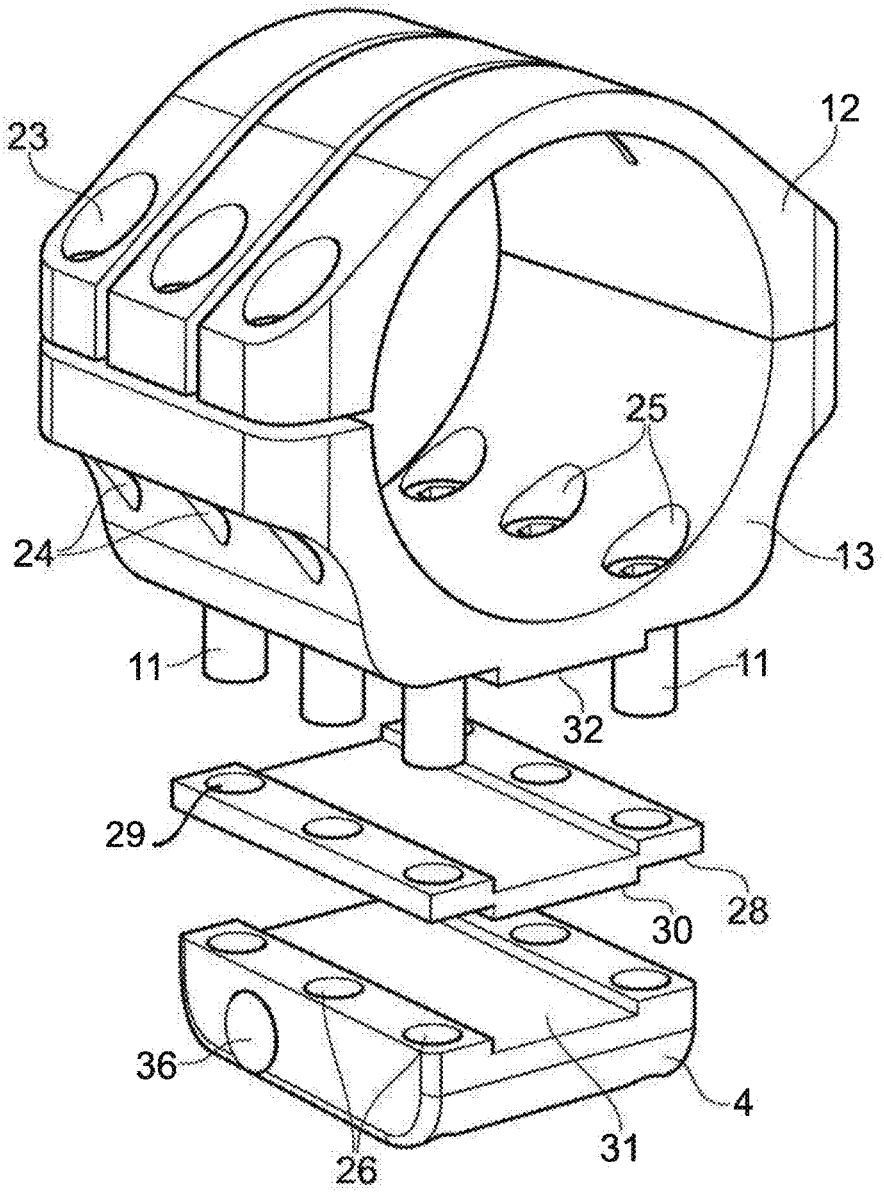
FIG. 3 shows details of a telescopic sight ring, an intermediate piece and a spacer.

FIG. 3 shows an embodiment of the device 1 for mounting and adjustment of a telescopic sight for a firearm which can be used to lift the device 1 up by one or more spacing plates 28 or spacers if one desires a higher mounting. The spacing plate 28 will be formed with the same number of holes 29 as the lower half rings 13 and the intermediate pieces 4, 6. When the lower half-ring 13, the spacing plate 28 and the intermediate piece 4, 6 are connected to each other through the screws 11, this assembly will be increased by the thickness of the spacing plate 28.

The spacing plate 28 is further formed with grooves 30, so as to be received more easily in the rear intermediate piece.

Figure 4:
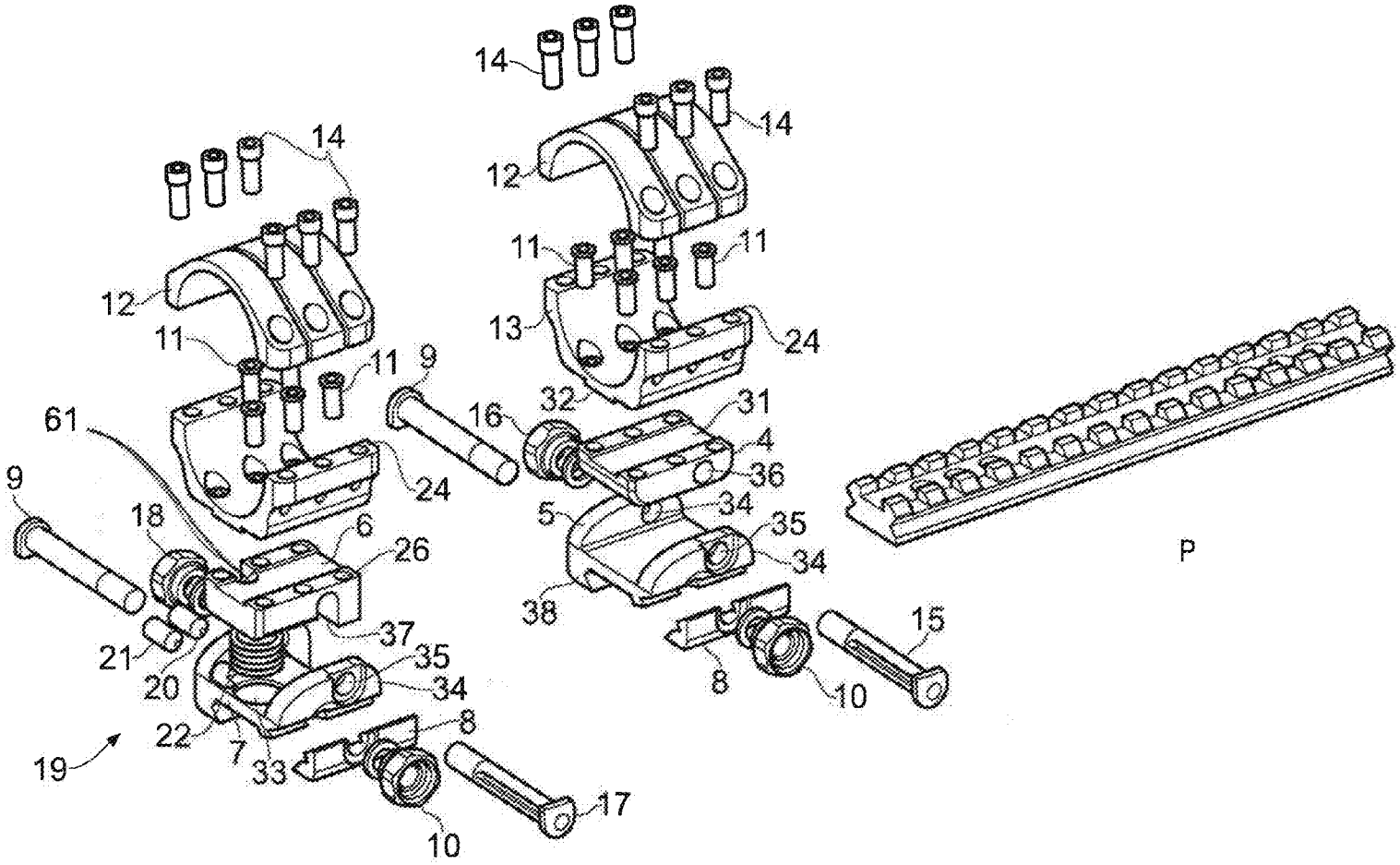
FIG. 4 shows a perspective view of the elements of the device.

FIG. 4 shows the different elements of the device 1 for mounting and adjustment of a telescopic sight when disassembled.

The front and rear intermediate piece 4, 6 is formed with a groove or recess 31, which groove or recess 31 is shaped complementarily to the groove 30 provided in the spacing plate 28, or a projecting portion 32 in the lower half rings 13.

The front base 5 is formed on a top side with two flanges 34, where through each flange 34 there is provided a through-going hole 35. Further, the front intermediate piece 4 is provided with a through-going hole 36, which hole 36 is arranged such that it aligns with holes 35 in the flanges 34 when the front intermediate piece 4 and the front base 5 are arranged correctly relative to each other. The front intermediate piece 4 is further formed with rounded edges. The front intermediate piece 4 and the front base 5 will be connected to each other through bolt 15 and nut 16. This connection will also be a pivot for the front intermediate piece 4 when the device 1 for mounting and adjustment of a telescopic sight is to be adjusted.

The rear base 7 is, in a similar way to the front base 5, formed with two flanges 34, where a through-going hole 35 is provided through each flange 34. The rear intermediate piece 6 will be provided with a recess 37, instead of a through-going hole as provided in the forward intermediate piece 4. The recess 37 is arranged such that it levels with the holes 35 in the flanges 34 when the rear intermediate piece 6 and the rear base 7 are arranged correctly relative to each other. The rear intermediate piece 6 and the rear base 7 will be connected with each other through bolt 17 and nut 18. Through this layout the rear intermediate piece 6 will be able to move vertically from the rear base 7.

The adjustment device 19 provided in the rear intermediate piece 6 and the rear base 7 includes a spring 22 disposed between the rear intermediate piece 6 and the rear base 7, as the rear base 7, on a top side, will then be formed with a seat or groove 33 for receiving the spring 22.

The set or adjustment screw 20, which at one end is formed with a tapering of between 15-50 degrees, for example 45 degrees, will, when screwed be pushed inwards against the spring 22 and engage a corresponding angled surface 61 provided internally in the intermediate piece 6, where this angled surface 61 is complementarily shaped with the tapering of the set or adjustment screw 20.

When the set or adjustment screw 20 is tightened, the set or adjustment screw 20 will be guided along the angled surface 61 in the rear intermediate piece 6, so as to push the rear intermediate piece 6 downwardly. The rear intermediate piece 6 will be allowed this movement, as the recess 37 in the rear intermediate piece 6 will allow the rear intermediate piece 6 to be moved relative to the rear ring base 7. The at least one spring 22 disposed between the rear telescopic sight base 7 and the rear intermediate piece 6 will then be compressed. When the set or adjustment screw 20 is turned in the opposite direction, i.e. out, the set or adjustment screw 20 will be pulled away from the angled surface 61 provided in the rear intermediate piece 6, whereby the at least one spring 22 will push the rear intermediate piece 6 upwards.

As the rear intermediate piece 6, due to the recess 37 can move freely relative to the rear ring base 7, the spring 22 will press the rear intermediate piece 6 up from the rear ring base 7, this movement resulting in that the front intermediate piece 4 will be rotated somewhat in relation to the front ring base 5. As the telescopic sight rings 2, 3 are connected to the front and rear intermediate pieces 4, 5, this will cause the telescopic sight to form an angle relative to a barrel of the firearm. When the desired angle is achieved, the tightening or locking screw 21 is used to "lock" the rear intermediate piece 6 in this position.

When the desired alignment is achieved, a tightening or locking screw 21 is used to lock the rear intermediate piece 6 and the rear ring base 7 in a fixed position to each other, where also the bolts and nuts connecting the front and rear intermediate piece and the front and rear ring base can be used as a further lock of the telescopic sight's position.

The front and rear base 5, 7 are also formed with two downwardly extending flanges 38, where one of these flanges 38 is formed with a groove on its inner side, so as to cooperate with a complementary groove provided in, for example, a Picatinny rail P. The clamp devices 8 may similarly be provided with a groove on their inner sides, so that the attachment of the front and rear base 5, 7 to the Picatinny rail P by means of clamp devices 8 provides a firm and locking connection.

Only the elements relating to the invention are explained and described above and a skilled person will understand that the device for mounting a telescopic sight on a firearm can be designed with more or fewer elements which are assembled to each other. The skilled person will further understand that, within the scope of the invention as defined in the appended claims, more embodiments and modifications of the described and illustrated embodiments can be provided.

The invention claimed is:

1. A device for mounting and adjustment of a telescopic sight on a firearm, comprising a front and a rear telescopic sight ring, wherein said front and rear telescopic sight ring comprises an upper half-ring and a lower half ring , the lower half-ring of each telescopic sight ring being connected to an intermediate piece, each intermediate piece further being connected to a telescopic sight base, where between a rear telescopic sight base and a rear intermediate piece there is arranged an adjustment device, wherein the adjustment device comprises at least one spring and at least a set or adjustment screw, wherein said at least one spring is arranged in a seat or groove in a rear telescopic sight ring base, said rear telescopic sight ring base further being provided with a recess, and wherein a rear intermediate piece on an inside is provided with an angled surface.

2. Device according to claim 1, wherein the lower half-ring of each said telescopic sight ring and each said intermediate piece is formed with a plurality of corresponding holes, so each said telescopic sight ring and each said intermediate piece can be connected to each other.

3. Device according to claim 1 or 2, wherein a front intermediate piece is formed with a through-going hole and the rear intermediate piece is formed with a recess, for receiving a bolt or screw.

4. Device according to claim 1, wherein each said telescopic sight ring base is provided with two upstanding flanges, where a through-going hole is formed in each flange.

5. Device according to claim 1, wherein the upper half-ring of said telescopic sight ring comprises three separate sub-half rings.

6. Device according to claim 1 or 4, wherein each said telescopic sight ring base is provided with two downwardly extending flanges on an underside, wherein each said flange, on an inside, over at least part of said flange's length, is formed with at least one groove.

7. Device according to claim 1, wherein the adjustment device further comprises a tightening or locking screw.

8. Device according to claim 1 or 7, wherein at least one set or adjustment screw is formed with a tapering of between 15-50 degrees.

9. Device according to one claim 8, wherein the angled surface in said rear intermediate piece forms an angle of between 15-50 degrees with a horizontal plane.

10. Device according to claim 9, wherein each said intermediate piece is formed with a groove over said intermediate piece's entire length for receiving a surface on a lower half-ring of a telescopic sight ring.

11. Device according to claim 10, wherein a front intermediate piece is arranged to be rotatably connected to a front telescopic sight ring base.

* * * * *